United States Patent [19]

Bessinger et al.

[11] Patent Number: 4,966,343

[45] Date of Patent: Oct. 30, 1990

[54] AESTHETIC SHELVING SYSTEM

[75] Inventors: Walter L. Bessinger, Grand Haven, Mich.; William E. Stumpf, Minneapolis; Casey L. Carlson, Edina, both of Minn.

[73] Assignee: Knape & Vogt Manufacturing Company, Grand Rapids, Mich.

[21] Appl. No.: 381,149

[22] Filed: Jul. 14, 1989

[51] Int. Cl.[5] ..... A47G 29/02

[52] U.S. Cl. ..... 248/243; 108/108; 211/26; 211/187

[58] Field of Search ..... 248/225.2, 235, 243, 248/247, 250, 74.1, 65, 73; 174/70 R; 108/108, 152; 211/26, 90, 134, 135, 186, 187, 153

[56] References Cited

U.S. PATENT DOCUMENTS

| | | | |
|---|---|---|---|
| 290,884 | 12/1883 | Howe . | |
| 1,084,276 | 1/1914 | Jaminet . | |
| 1,983,470 | 12/1934 | Knape | 248/19 |
| 2,576,865 | 11/1951 | Vanderveld | 248/243 |
| 2,788,902 | 4/1957 | Nowicki | 211/147 |
| 3,088,424 | 5/1963 | Knuth | 108/108 |
| 3,167,609 | 1/1965 | Brann | 174/70 R |
| 3,199,822 | 8/1965 | Ruhnke | 248/243 |
| 3,234,897 | 2/1966 | Berk | 108/108 X |
| 3,265,344 | 8/1966 | Ornstein | 248/243 |
| 3,284,116 | 11/1966 | George | 287/20.92 |
| 3,290,846 | 12/1966 | Mader | 248/243 X |
| 3,295,474 | 1/1967 | Ornstein | 108/152 |
| 3,339,751 | 9/1967 | Bard | 211/193 |
| 3,490,393 | 1/1970 | Nelson | 108/109 |
| 3,513,786 | 5/1970 | Kellogg | 108/64 |
| 3,645,486 | 2/1972 | Ferdinand | 211/90 X |
| 3,652,048 | 3/1972 | Hartman | 108/108 X |
| 3,701,325 | 10/1972 | Fenwick | 108/1 |
| 3,765,344 | 10/1973 | Ferdinand | 108/152 X |
| 3,984,077 | 10/1976 | Shine | 248/248 |
| 4,067,165 | 1/1978 | Timmons | 52/585 |
| 4,098,480 | 7/1978 | Neumann | 248/243 |
| 4,183,487 | 1/1980 | Swain | 248/214 |
| 4,327,838 | 5/1982 | Cooke | 211/184 |
| 4,431,155 | 2/1984 | Engel | 248/243 |
| 4,441,300 | 4/1984 | Varon | 52/36 X |
| 4,498,653 | 2/1985 | Quest | 248/225.2 |
| 4,535,525 | 8/1985 | Varon | 248/243 X |
| 4,553,674 | 11/1985 | Yoshikawa | 211/26 |
| 4,615,163 | 10/1986 | Curtis et al. | 52/703 |
| 4,624,376 | 11/1986 | Bertram | 211/187 |
| 4,641,469 | 2/1987 | Wood | 52/309 |
| 4,658,969 | 4/1987 | Mastrodicasa | 211/187 |
| 4,796,845 | 1/1989 | Regel | 248/243 |
| 4,886,235 | 12/1989 | Thornborrow | 248/243 |

FOREIGN PATENT DOCUMENTS

| | | | |
|---|---|---|---|
| 0020842 | 1/1981 | European Pat. Off. | 248/243 |
| 1289272 | 2/1969 | Fed. Rep. of Germany . | |

OTHER PUBLICATIONS

Knape & Vogt Catalog KV 72-PB, pp. A13, A14 & A15, Xerographic Copy of "Fastex" Brand Plastic Pop Rivet, Knape & Vogt Sales Literature (2 pages).

*Primary Examiner*—J. Franklin Foss

*Attorney, Agent, or Firm*—Price, Heneveld, Cooper, DeWitt & Litton

[57] ABSTRACT

A shelving assembly having vertical standards and cantilever brackets, an elongated generally U-shaped cover over each standard, its legs being resiliently biased toward the standard, and there being a space extending in from the apex of the cover and straddled by flanges which integrally join a cross piece forming webs and vertically spaced slots generally coinciding with slots in the standard. The legs hold the cover on the standard. The bracket holds the cover vertically in place. The cover flanges laterally stabilize the bracket. Caps and collars project from the ends of the standards. The brackets have slotted shelving mounts fitted in upper edge recesses of the brackets, each mount having an upper adhesive pad and a vertical jack for temporarily holding a shelf up off the adhesive. The jacks are shiftable down under limited predetermined force to lower the shelf onto the adhesive for anchoring. A wire clip for guiding an electric wire is attachable to the standard by lug engagement.

28 Claims, 4 Drawing Sheets

AESTHETIC SHELVING SYSTEM

BACKGROUND OF THE INVENTION

This invention relates to shelving systems employing vertical slotted standards that mount to the wall and have cantilever brackets attached thereto. Such systems typically are employed for utility purposes as in home workshops, recreation rooms, children's bedrooms, garages and the like, and far less frequently in rooms of the house containing special furniture, or in office areas. This is largely because these known systems typically do not have a finished "dress" appearance due to coarse hardware being visible.

The cantilever brackets for this equipment are typically made of stamped steel plate stock attached to the standards by hooked lugs on one end of the brackets. A further disadvantage of such brackets is potential side sway. In order to limit side sway of such brackets under load, the brackets have previously been provided with special features such as a transverse clip as in U.S. Pat. Nos. 1,983,470 to J. J. Knape and 3,135,491 to H. F. Knape et al, or use of double brackets for each standard. If the brackets are allowed to move laterally, the shelves will also move. This is undesirable. Additionally, with some structures the shelf can be moved relative to fixed brackets. This can result in accidental shelf spillage. Prior devices have been developed so that the shelf is supported on saddle type clips on the brackets (see for example U.S. Pat. No. 3,199,822), or attached by adhesives (see for example U.S. Pat. No. 3,265,344). This latter feature adds some stability. However, assembly of such can be difficult and frustrating because the adhesive tends to lock the shelf in place where it is initially positioned, even though this may not be the desired final position.

These and other shortcomings are known to those in the art of cantilever shelving.

RELATED APPLICATIONS

This application is related to copending applications Ser. Nos. 381,160, filed Jul. 14, 1989, entitled SHELVING MOUNT SYSTEM; Ser. No. 381,148, filed Jul. 14, 1989, entitled INTERLOCK SHELVING BRACKET AND STANDARD COVER; Ser. No. 381,108, filed Jul. 14, 1989, entitled BEAM AND TELESCOPIC CONNECTOR SHELVING SYSTEM; Ser. No. 381,122, filed Jul. 14, 1989, entitled BOOK END BRACKET AND SHELVING SYSTEM; and Ser. No. 381,150 filed Jul. 14, 1989, entitled PIN and CLIP SHELF MOUNTING.

SUMMARY OF THE INVENTION

The present invention provides a novel shelving system wherein features adding aesthetic appeal also add stability to the shelving. A specially configurated elongated cover for the vertical standards is resiliently held on the standards, is vertically secured by attached cantilever brackets, and in turn laterally stabilizes the brackets. This special cover plus end caps on the standards effect a finished aesthetic appearance as well, rendering the structure useful in parts of the home or offices which contain higher class furnishings. The slotted hardware standards are not visible to detract from the appeal.

Even though the special cover extends over and hides the slots of the metal standard, the cantilever brackets are readily engaged with the standard. Moreover, the load stress from the bracket is applied directly to the metal standard rather than the cover which is preferably of polymeric material. Brackets with two or more lugs can be attached as desired. Accidental or inadvertent dislodgement of the brackets from the standards by a vertical force on the bracket is resisted by the bracket lug configuration and dimensions.

Covers are interchangeably attached to the standards so that a selected color and style can be chosen for each location.

The shelves themselves are supported on special mounts attached to the brackets and to which the shelves are ultimately preferably adhered. The adhesive action, however, does not occur until the shelf is positioned in its final desired location and the shelf shifted downwardly to activate the adhesive. This is achieved by having special mounts with shiftable jacks that hold the shelf elevated until the final position is achieved. The mounts provide substantial support as well as aesthetic appeal.

These and other advantages and features will become apparent to those in this art upon studying the detailed disclosure.

Figure 1:
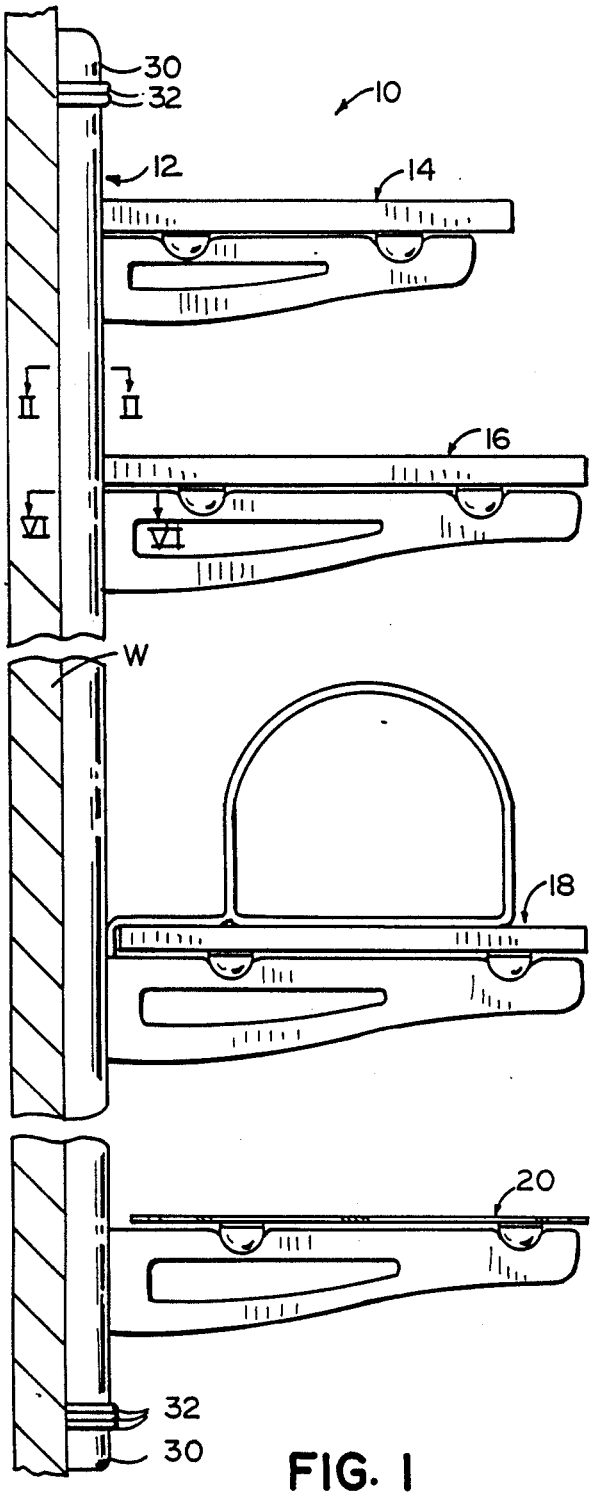
FIG. 1 is an elevational view showing the invention relative to four different shelf arrangements on standards.
Figure 4:
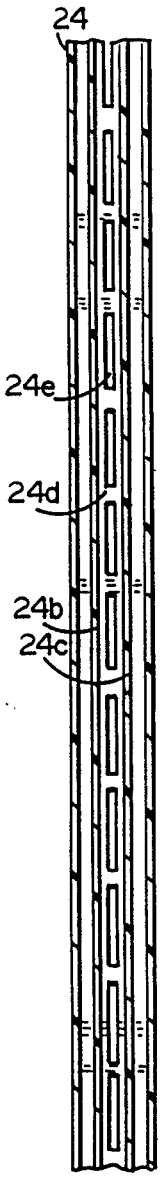
FIG. 4 is a sectional view taken on plane IV—IV of FIG. 3.
Figure 14:
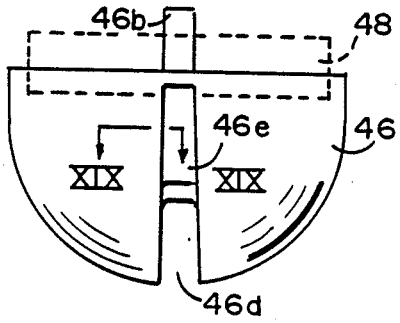
FIG. 14 is an end elevational view of the mount in FIGS. 10–12, showing the adhesive pad in hidden lines.
Figure 15:
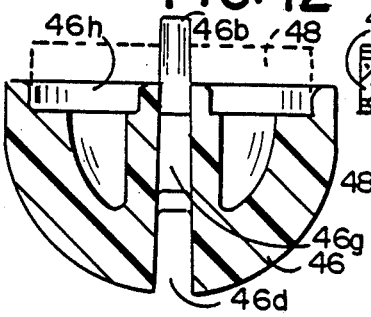
FIG. 15 is a sectional view taken on plane XV—XV in FIG. 11.
Figure 18:
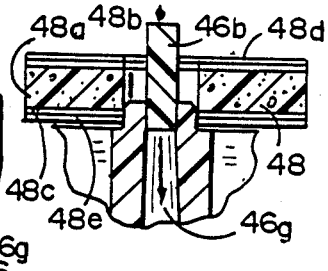
Figure 19:
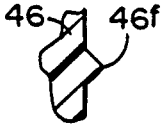
Figure 16:
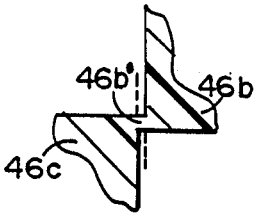
FIG. 16 is a greatly enlarged fragmentary sectional view of an initial juncture in the device of FIG. 12.
Figure 20:
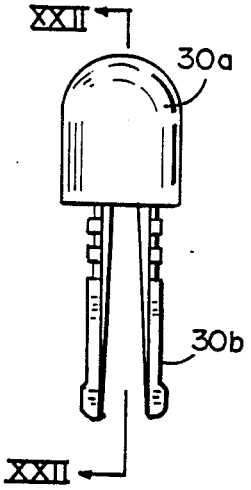
Figure 21:
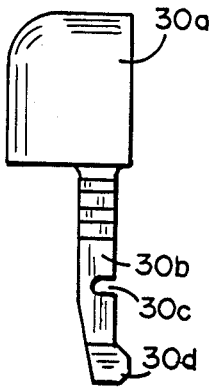
Figure 22:
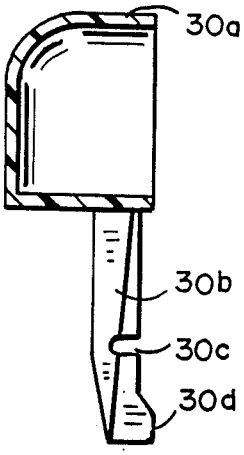
Figure 23:
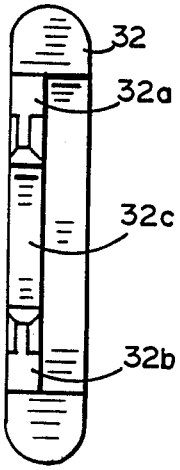
Figure 24:
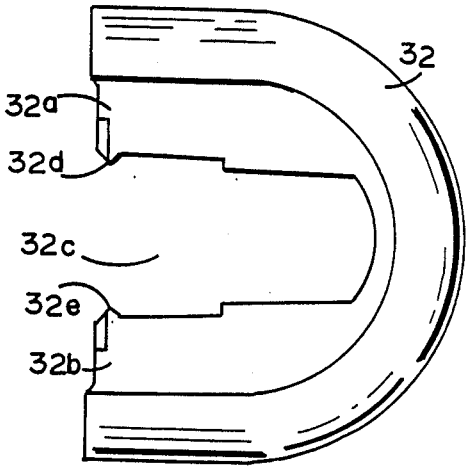
Figure 25:
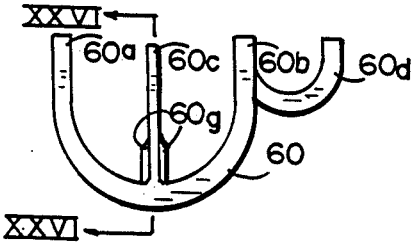
Figure 26:
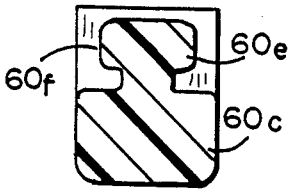

10 et seq. subsequent to breakage of the juncture and prior to placement of a shelf thereon;

FIG. 18 is an enlarged fragmentary sectional view of the mount with an adhesive pad thereon;

FIG. 19 is a greatly enlarged fragmentary sectional view of a crush rib, taken on plane XIX—XIX of FIG. 14;

FIG. 20 is a front elevational view of a dress cap at the upper and lower ends of the standard structure in FIG. 1;

FIG. 21 is a side elevational view of the cap in FIG. 20;

FIG. 22 is a sectional view taken on plane XXII—XXII of FIG. 20;

FIG. 23 is a rear elevational view of a decorative collar at the top and the bottom of the structure in FIG. 1;

FIG. 24 is a plan view of the collar in FIG. 23;

FIG. 25 is a plan view of a wire clip for the assembly;

FIG. 26 is a greatly enlarged fragmentary sectional view of the connector portion of the clip in FIG. 25.

DESCRIPTION OF THE PREFERRED EMBODIMENTS

In FIG. 1 is disclosed a shelving assembly 10 comprising vertical standard subassembly 12 and four representative shelf and bracket subassemblies 14, 16, 18 and 20.

Figure 7:
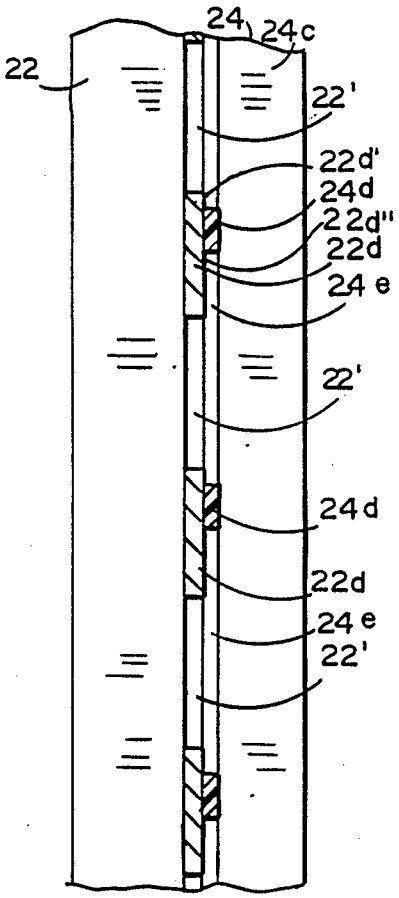
FIG. 7 is a sectional view taken on plane VII—VII on FIG. 5.
Figure 10:
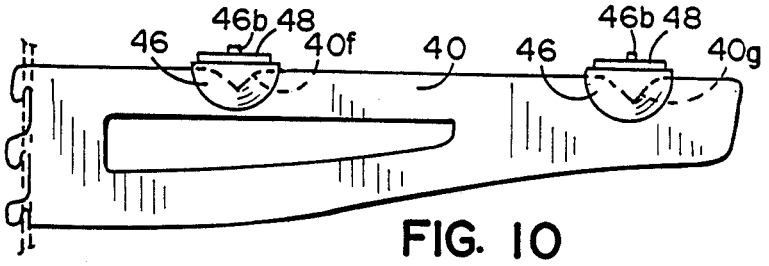
FIG. 10 is a side elevational view of a bracket and a pair of hemispherical mounts prior to placement of a shelf thereon.
Figure 11:
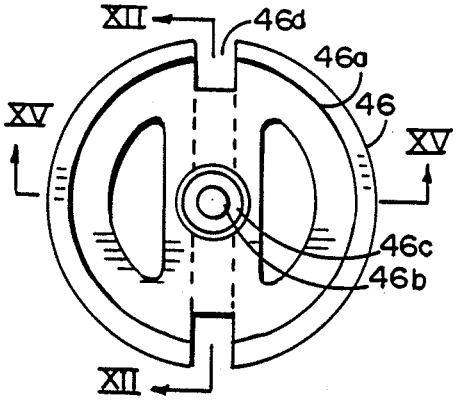
FIG. 11 is a top plan view of one of the mounts in FIG. 10 prior to insertion of the adhesive pad.

Standard subassembly 12 comprises a conventional generally U-shaped upright vertical standard 22 (FIG. 2) having a front face 22*a*, normally flat, and a pair of side faces 22*b* and 22*c* spaced from each other and typically parallel to each other. The U-shaped structure is integral, being formed of metal such as steel, aluminum or the like. Front face 22*a* has a plurality of vertically spaced, vertically elongated slots 22' for receiving connecting lugs of shelf brackets in a manner to be described hereinafter. Between these slots are transverse webs 22*d* behind which the lugs engage (FIG. 7).

Figure 2:
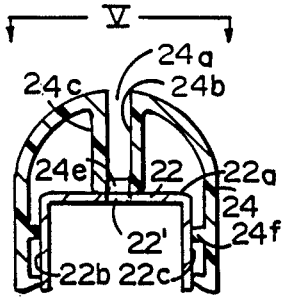
FIG. 2 is a sectional view of a shelf support standard and its cover taken on plane II—II of FIG. 1.
Figure 5:
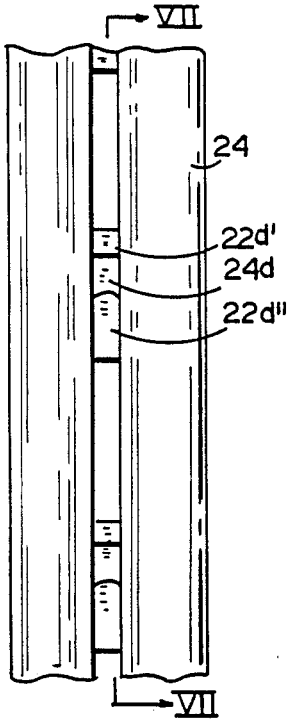
FIG. 5 is an enlarged view taken in the direction V in FIG. 2.
Figure 6:
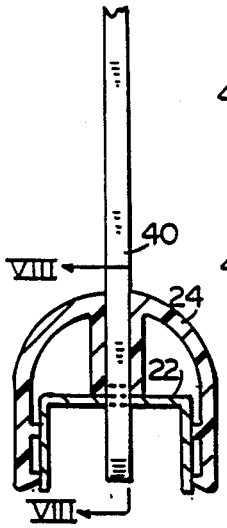
FIG. 6 is a fragmentary sectional view taken on plane VI—VI of FIG. 1.

Standards 22 are mounted in conventional fashion to a fixed vertical support, usually a wall W, as by screws extending through openings (not shown) provided in the standard, for securement in spaced parallel fashion to the wall W (FIG. 1). Encompassing at least the front face and the side faces of standard 22 is a resilient polymeric dress and stabilizing cover 24, herein called simply a dress cover for convenience. Dress cover 24 is generally U-shaped in configuration, preferably having a convexly curved front with a central outer apex and a pair of side legs 24*g* and 24*h* extending rearwardly from the apex past the front face of standard 22 to engage the side faces thereof as well as cover all three faces. At the front apex of cover 24, which is spaced forwardly from the standard front face 22*a*, is a vertically elongated space 24*a* basically extending the length of the cover. This space extends inwardly between a pair of vertically elongated side flanges 24*b* and 24*c*. These flanges are integral with the remaining portions of the cover and extend from the outer apex inwardly toward the front face of standard 22 where they engage the standard and are interconnected by a plurality of vertically spaced transverse webs 24*d* (FIG. 5). These webs are spaced by intermediate vertically elongated slots 24*e* (FIG. 2). Slots 24*e* of the cover are longer than standard slots 22' as will be explained more fully hereinafter. Webs of the cover are shorter than webs of the standard. Each of the legs of dress cover 24 includes a pair of ribs 24*f* on the inside face thereof to engage standard side faces 22*c* and 22*b*. Cover 24 projects in front of standard 22 at least about double the thickness, from front to back, of the standard, The slots in the standard and in the cover are therefore recessed considerably to not normally be visible except to someone looking directly into the slot at close range. The result is aesthetically pleasing as well as structural stability.

Figure 3:
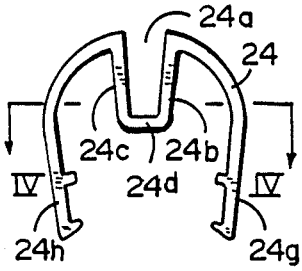
FIG. 3 is a top plan view of the cover component in FIG. 2, but in its freestanding form not connected to the standard.

In its free state, dress cover 22 preferably appears as in FIG. 3, i.e., with its legs canted toward each other rearwardly from the apex, in response to an inherent resilient bias. Flanges 24*b* and 24*c* have a resilient bias away from each other, thus extending divergently outwardly, i.e., forwardly from the transverse webs 24*d* to the outer front apex of member 24. The space in between the free rear ends of the legs of member 24 is less than the spacing of side faces 22*a* and 22*b* of standard 22 from each other, so that the legs must be spread against the inherent resilient bias of the cover member 24 when placing it over the standard. This spread against the inherent resilient bias causes the legs, and particularly ribs 24*f* thereof, to subsequently squeeze and grip the standard side faces for retention. When these legs are spread, this also causes flanges 24*b* and 24*c* to move toward each other to a spacing equal to or slightly less than the thickness of the plate type brackets to be connected to the standard. Cover 24 is preferably of polymeric material such as polystyrene or the equivalent formed as by extrusion. It can be any of a multiple of colors and have various surface characteristics such as grooves, ribs, scallops, striations, etc.

The stabilizing cover just described is preferred. However, a stabilizing cover with less than all of these characteristics could be employed, such as a dual durometer cover with relatively fixed legs spaced apart an amount slightly greater than the width of the standard, and having flexible resilient ribs at 24*f* for flexibly gripping the standard side walls. Such a cover could be made of polyvinylchloride (PVC), for example, with the ribs of a different durometer than the main body.

The structure in FIG. 1 is shown to include caps and decorative collars at the upper and lower ends of the standards. The individual caps are preferably shaped compatible with the configuration of dress cover 24 but can be a variety of configurations. That shown in the drawings is slightly elongated. However, this cap could be spherical in shape or have some other configuration and/or special surface decoration. Surface decorations such as scallops, ribs or ridges of various selected size and shape may be applied to cover member 24 as well as the caps. Each upper and lower cap 30 is shown to include the exposed dress portion or head 30*a* (FIGS. 20–22) and also a pair of depending spring legs integral with the head and insertable between the wall surface and the front wall of standard 22. The caps and legs can be molded in one piece. Legs 30*b* include cutout flex areas 30*c* therein, intermediate their length, and laterally protruding, wall engaging feet 30*d*, so that insertion of the legs into the upper and lower ends of standard 22 causes engagement of feet 30*d* with the wall, and of the knee portion of the legs with the inside surface of the standard front, to apply flexing action about cutouts 30*c*. This causes resilient connection friction of the legs on the wall and standard at the ends of the cover to hold the caps in place. The outer two surfaces of legs 30*b* include horizontal grooves to receive one or more (here shown to be three) collars. Two of such collars are depicted at the top of FIG. 1, and three at the bottom as examples. If no collars are used, the caps just abut squarely against the upper edge of cover 24. If one or more collars are used, the cap abuts against a collar, and a collar abuts the end of the cover.

Connection of collars 32 (FIGS. 23–24) is readily achieved by placing these in horseshoe fashion about the spring legs 30*b* of the cap. Each collar 32 has a pair of flanges 32*a* and 32*b* (FIG. 24) straddling a slot 32*c* therebetween. This slot includes an enlarged portion near the opening, and a pair of facing protrusions 32*d* and 32*e* for engaging behind spring legs 30*b* of cap unit 30. The selected number of collars is therefore positioned on the spring legs by pressing the collar against the front of the legs, causing the legs to momentarily be shifted toward each other against the bias inherent in the polymeric structure until the legs snap back into the outer enlarged space of slot 32*c*.

Connection of a bracket to a standard will be understood best from FIGS. 5–9. The shelf support bracket 40 or 140 is basically a plate member formed in conventional manner from flat plate stock. Each bracket has at least two vertically spaced lugs at one end for connection to like vertically spaced transverse webs 22*d* between the vertical slots 22' of the standard. Each of the four exemplary shelf subassembly variations depicted in FIG. 1 employs two plate type brackets having at least two lugs on the rear of the bracket. The top unit 14 in FIG. 1 has a shorter length bracket, e.g., a seven inch long bracket with a wood shelf thereon; the second unit 16 has a longer and larger bracket with a wider shelf thereon; the third unit 18 has such a bracket and shelf with a book end attached thereto; and the fourth unit 20 has a bracket supporting a thinner shelf as of glass.

Figure 8A:
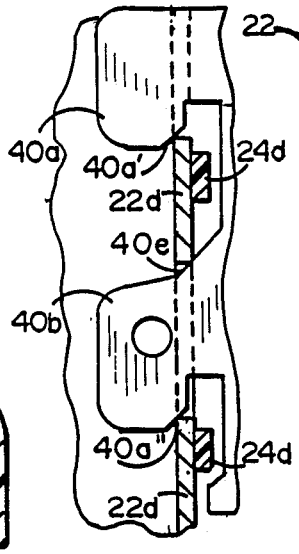
FIG. 8A is a sectional view of the structure in FIG. 8, showing interengagement of the bracket and standard occurring under the influence of direct vertical force applied to the shelf and/or bracket.
Figure 8:
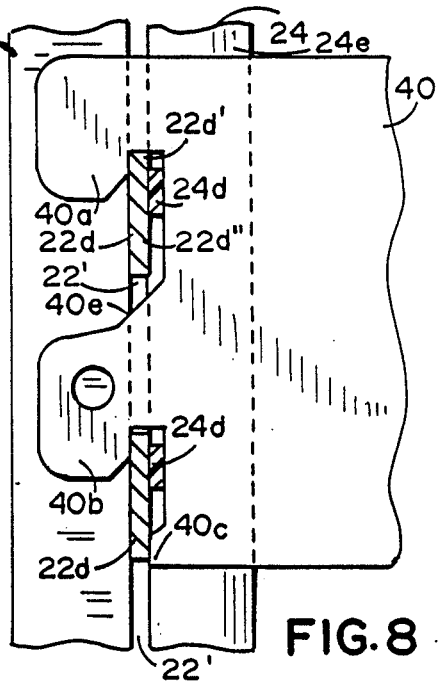
FIG. 8 is a sectional view comparable to FIG. 7 but with a two lug bracket attached to the standard

Insertion of bracket 40 into the elongated space 24*a* of cover 24 causes the cover flanges 24*b* and 24*c* to grip the side walls of this bracket due to the inherent resilience of the cover legs toward each other, and also the inherent resilient of the junctures of flanges 24*b* and 24*c* with cross webs 24*d*. The cover extends in front of the standard an amount about equal to the depth of the standard so that flanges 24*b* and 24*c* have a substantial area of contact with the bracket. Therefore, when the bracket is attached to the standard, cover 24 provides significant lateral stability to inhibit lateral movement of the bracket. Each of the bracket lugs, e.g., upper lug 40*a* and lower lug 40*b* on a two lug bracket (FIG. 8) extends rearwardly from the one end of the bracket body, and specifically the bracket rear edge, and then downwardly to engage behind webs 22*d*. The forward surfaces of these lugs are spaced rearwardly from the rear bracket edge a amount at least equal to substantially the combined thickness of standard web 22*d* and cover web 24*d*, whereby this space may receive both webs therein as depicted in FIG. 8. Preferably, when the upper lug is engaged down flush against the upper edge of a web 22*d* with which it is cooperative, lower lug 40*b* will be spaced slightly, e.g. approximately 0.015 of an inch or so above the web 22*d* adjacent it, to assure secure interengagement between the upper lug and its web since most of the tensile stress occurs at upper lug 40*a*. Preferably, there is also a clearance between the upper edge of polymeric web 24*d* and the upper lug, i.e., an exposed area 22*d'* adjacent the top of web 22*d*, to prevent the lug 40*a* from bottoming out on the resilient polymeric web 24*d*. Such an occurrence could prevent the most secure mounting of the bracket. Also, the extra length of the cover slots 24*e* relative to the length of standard slots 22', i.e., the fact that polymeric web 24*d* is shorter than metal web 22*d*, allows an exposed area 22*d''* at the base of web 22*d*. Cooperative with this exposed area is a rearwardly projecting abutment 40*c* at the bottom portion of bracket 40, i.e., below lower lug 40*b* (FIG. 8). This abutment 40*c* is spaced forwardly from lug 40*b* an amount equal approximately to the thickness of web 22*d*, but offset below it. This causes the compressive load on the bracket to be applied directly against the metal web rather than the polymeric web, for stability.

Extending diagonally upwardly from the upper edge of lower lug 40*b* to the rear edge of the bracket body is an upwardly forwardly sloping surface 40*e*. This serves at least two functions. Firstly, during insertion of the bracket lugs, engagement of surface 40*e* with the lower edge of web 22*d* thereabove acts as a camming surface to cause the bracket to move downwardly into position with the lugs behind the webs. Secondly, once installed, the bracket cannot readily be accidentally dislodged by upward vertical force on the bracket and/or shelf since the throat area between surface 40*e* on the lower lug and the correspondingly sloped, generally parallel surfaces 40*a'* and 40*a''* (FIG. 8A) on the bottom of lug 40*a* thereabove, is approximately the height of web 22*d* and if measured diagonally, upwardly-rearwardly, is less than the height of this lug. Like sloped surface 40*a''* on lug 40*b* engages the upper rear edge of a web 22*d* simultaneously with surface 40*a'* engaging another web 22*d*. Thus, simple vertical movement of bracket 40 will not dislodge it from the webs, nor vertical movement plus counterclockwise rotation. Rather it must be lifted and simultaneously pulled forwardly away from the standard to disconnect the bracket from the standard.

Figure 9:
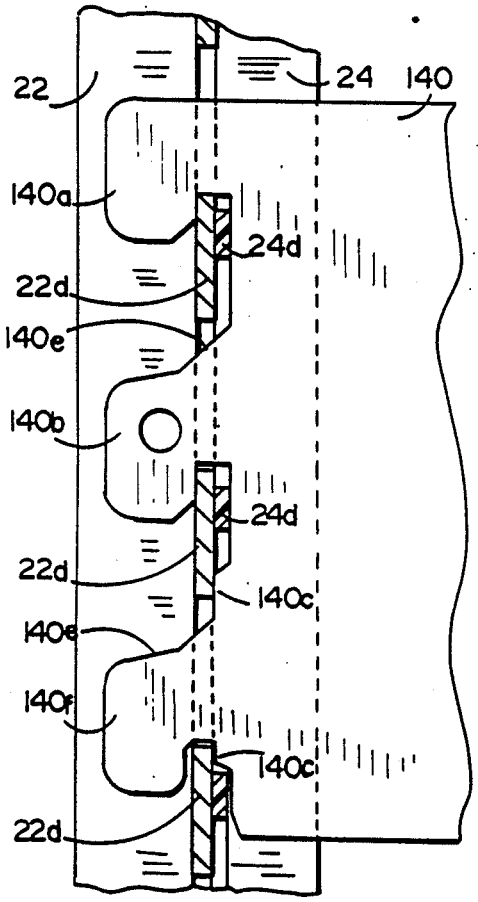
FIG. 9 is a sectional view comparable to that in FIG. 7 but with a three lug bracket attached to the standard.

In FIG. 9 is depicted a three lug bracket 140. Upper lug 140*a* and intermediate lug 140*b* are comparable to upper lug 40*a* and lower lug 40*b* in FIG. 8. Abutment 140*c* is comparable to abutment 40*c* in the two lug bracket, engaging the exposed area of a web 22*d* as an auxiliary abutment. Beneath these two lugs is a third lug 140*f* which engages behind a third web 22*d* of standard 22. Preferably lowermost lug 140*f* has a clearance between its front face and the rear face of web 22*d*, to assure full abutment between upper lug 140*a* and its cooperative web. An additional primary abutment 140*c'* can be provided adjacent the third lug to engage, for example, the upper exposed portion of its adjacent web 22*d*. The spacing between each lug and the rear edge area of the body of bracket 140 accommodates the combined thicknesses of the standard web and the cover web as explained heretofore.

Figure 12:
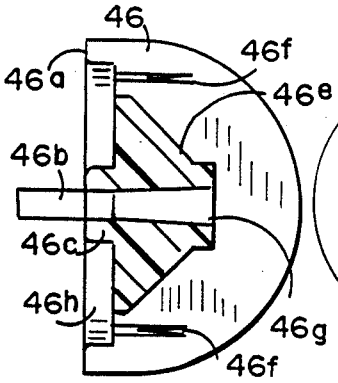
FIG. 12 is a sectional view taken on plane XII—XII of FIG. 11.
Figure 13:
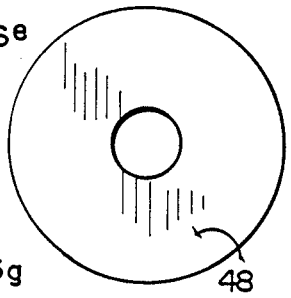
FIG. 13 is a plan view of the adhesive pad to be placed on the mount.

Combined with each bracket are at least two mounts 46, the preferred form of which is depicted in FIGS. 10–19. Bracket 40 includes a pair of generally V-shaped recesses in its upper edge to interfit with these mount elements. These two generally V-shaped recesses 40*f* and 40*g* are spaced from each other along the length of the bracket. Positioned at these recesses is a pair of mounts 46. These mounts are preferably hemispherical in configuration having a generally flat circular upper portion to receive a flat circular adhesive disc 48. This disc is preferably of a foam polymeric material to have limited compressibility. It rests in a top recessed surface or cavity 46*h* of the mount, surrounded by an upper rim 46*a* (FIG. 12). Disc 48 extends a small amount about rim 46*a*. It has a central opening to fit around a center jack 46*b* to be described hereinafter and a hub 46*c* around the jack. An arcuate slot 46*d* extends around the lower periphery of mount 46. At the central base of this slot is a generally V-shaped mating surface 46*e* configurated generally like the substantially V-shaped recesses 40*f* and 40g, to rest on the edges of these recesses while straddling bracket 40. This slot preferably includes deformable means such as a pair of small crush ribs 46f (FIG. 19) which can be deformed when the mount is forced down into its straddling position onto plate bracket 40, assuring a tight friction fit. This mount, including the crush ribs and the central connector 46e as well as vertically extending jack 46b, are preferably formed of polymeric material integrally molded in one piece. As molded, the lower edge of cylindrical jack 46b is connected by a peripheral frangible web 46b' (FIG. 16) at its base between hub 46c and the base of jack pin 46b. This frangible juncture can be broken by downward force of a predetermined amount on jack 46b, at which time the lower portion of jack 46b is moved down part way into an underlying and surrounding channel or cavity 46g (FIG. 12 and FIG. 18) with a friction fit. Also, the frangible juncture (flash) on the jack is carried into the surrounding channel or cavity 46g to enhance this friction fit In this position, the jack still projects above the adhesive surface of disc 48. This friction fit can be overcome by a second lesser predetermined force for purposes to be described.

Breakage of the frangible connection can be performed at the molding dies or subsequently. It is anticipated that application of the first larger predetermined force to break frangible joint 46b' will be performed by the injection mold at the manufacturer, or someone else prior to the ultimate purchaser, although it could conceivably be performed by the purchaser. This causes the jack pin 46b to shift from the position illustrated in FIG. 12 to that illustrated in FIG. 17. In this second condition, the jack pin is still elevated above the upper adhesive surface of pad 48 as noted above. It can be lowered further by a lesser predetermined force because such need only overcome the friction between the jack pin and its recess or cavity 46g. In FIG. 18 the mount is shown having received the adhesive pad member 48. Although it is illustrated with the foam polymer central layer 48a with its upper and lower adhesive layers 48b and 48c covered by separable protective layers 48d and 48e, respectively, typically these protective layers would have been removed when the pad is placed on hub 46c around jack pin 46b.

In this preferred embodiment of the mount, the jack is a centrally located pin. Alternatively, it could be a downwardly shiftable projection of another configuration and/or location on the mount, such as an upwardly projecting cylindrical ring, plug, spherical element, pivotal link or other device projecting above the adhesive surface and depressible under a predetermined force to a lowered position at or below the adhesive surface.

In FIGS. 25 and 26 is also disclosed a wire clip which constitutes a generally U-shaped body 60 with a pair of spaced legs 60a and 60b that can straddle cover element 24 at a selected location. Several of these can be placed at spaced vertical intervals on cover 24. Extending from the center of this body, inwardly, generally parallel to the terminal portions of legs 60a and 60b, is a connector element 60c which has upper and lower lugs 60e and 60f symmetrically on the upper and lower edges thereof to allow this member to be attached to the standard in either of two 180° rotational positions. Extending from one side of this member, i.e,. from leg 60b, is a generally U-shaped wire retention element 60d enabling an electrical wire to be positioned therein. Thus, wiring can be run alongside the standard. By rotating the clip 180°, the wire can be held on either side of the standard. Optionally, this member may also include a pair of crush ribs 60g. The member is preferably formed of polymeric material. These ribs will therefore provide a friction fit with flanges 24b and 24c of cover 24 when connector element 60c is slid between them, as well as one of lugs 60e and 60f engaging behind a web 22d of standard 22.

Assembly of the shelving apparatus is relatively straightforward and easy. At least two of the vertical standards 22 are spaced from each other at predetermined distances, each vertically oriented and parallel to the other, and then mounted to a wall in conventional manner as by screws (not shown). The cover is then ready to be installed on each standard. Cover element 24 in its freestanding form (FIG. 3) is resiliently deformed by spreading its legs to the width of standard 22 and sliding it over the standard so that ribs 24f tightly engage outer faces 22b and 22c of the standard. This cover is pressed onto the standard until webs 24d bottom out against the front face 22a and slots 24e are generally aligned with but longer than slots 22' of the standard. Spreading of the legs of the cover enables it to frictionally grip the outer sidewalls of the upright standards as well as closing space 24a to an amount slightly less than the width of the bracket body. The differential length of the slots as well as the corresponding webs causes exposed areas of the standard webs at least below, and preferably above and below, cover webs 24d as at 22d' and 22d'' (FIGS. 5, 7 and 8). Typically the cover will be the same length as the standard so that alignment of the ends thereof will cause proper positioning of the corresponding slots and corresponding webs. Additional indicia may also be provided on the cover to aid in its orientation and position on the standard. As examples, one end of the cover slots could be of different shape, one end of the cover could have markings, etc.

At this time, caps 30 and the selected number of collars 32 are placed at the upper and lower ends of the covers. Spring legs 30b are inserted into the space defined between the wall and the standard, with feet 30d of the spring legs engaging the wall and the knees engaging the standard to apply a flexing force about cavities 30c for securely retaining the caps in position. The brackets are then ready to be placed into engagement with the other components.

More specifically, the lugs extending from the rear end of the bracket body are forceably inserted through the vertically elongated space 24a such that the bracket sidewalls have a friction fit with flanges 24b and 24c. The lugs also extend through the elongated slots of the cover and the adjacent elongated slots of the web, after which downward inward pressure is applied to the bracket to cause lugs 40a, 40b or 140a, 140b and 140f to engage behind the standard webs 22d. The brackets lock cover 24 in position, as well as the cover stabilizing the brackets. If desired, the spacing between the front edge of the lugs and the rear edge of the bracket body can cause the polymeric webs 24d to be put under some compression. The resulting increased frictional resistance to removal of the bracket can be advantageous. These polymeric webs can have a slight convexity, i.e., crown, such that this insertion of the bracket flattens out the crown to apply compression against the rear edge of the bracket body. This insertion of the bracket is aided by camming surface 40e on the two lug bracket and camming surfaces 140e on the intermediate and lower lug of the three lug bracket (FIG. 9). These same surfaces prevent inadvertent vertical movement of the bracket from the standards by a vertical force accidentally applied to the outer end of the brackets because of the restricted throat area between the lugs relative to the height of the standard webs (FIG. 8A). Yet, the brackets can readily be moved vertically and forwardly to purposely release them. After a pair of brackets are securely inserted at the same level in the pair of standards, a pair of mounts 46 is placed on and astraddle of each bracket. Each mount is positioned in a corresponding recess 40*f* such that the support surfaces 46*e* engage the correspondingly configurated edges of recess 40*f*.

Figure 17:
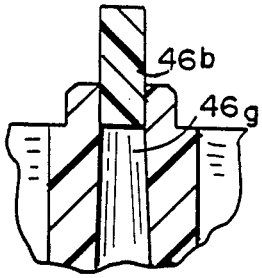
FIG. 17 is a greatly enlarged fragmentary sectional view of the upper central portion of the mount in FIGS.

At this point, jack 46*b* may have had its frangible joint 46*b'* previously broken loose from hub 46*c* so as to be partially lowered into the position illustrated in FIG. 17, but its upper end still above the adhesive surface. Such an adhesive surface is provided by placing the foam disc 48 having adhesive on both surfaces thereof onto the top flat portion of the hemispherically shaped mount 46, i.e., into recess 46*h*. The lower adhesive surface of the disc anchors the disc to the mount. A shelf is then placed upon the four upstanding jacks 46*d* of two spaced parallel brackets. The shelf will not contact the adhesive at this point so that it can be readily shifted about to the desired final position. Once so located, a small predetermined downward force is applied to the shelf to shift jack pins 46*b* down into their cavities or channels 46*g*, allowing the bottom surface of the shelf to engage the upper adhesive surface on the discs at the top of each mount. The shelf is thus secured in position.

Any inadvertently applied lateral force on the shelf will tend to be overcome because of the adherence of the shelf to these mounts, the placement of the mounts in the recesses, and the stabilizing effect of cover 24 on brackets 40 against lateral forces. Likewise, inadvertently applied vertical forces on the outer edge of the shelf will be resisted by the adhesion of the shelf to the mounts, the mounts to the brackets, and the inability of the bracket lugs to be released from their standard slots unless a combined forward and upward movement is purposely applied.

In addition to the many features and advantages specifically noted above, those skilled in the art, upon studying this disclosure, may perceive of other advantages to be gained. Further, certain variations can be made in the individual components of this assembly without departing from the concept of the invention which is illustrated by the preferred embodiment depicted. It is not intended that the invention is to be limited to this specific illustrated preferred embodiment, but rather only by the scope of the appended claims and the reasonably equivalent structures to those defined therein.

The embodiments of the invention in which an exclusive property or privilege is claimed are defined as follows.

1. A shelving standard and bracket assembly comprising:

vertical standards to be mounted to a wall in spaced parallel relationship to each other;

said standards each having a front face and a pair of spaced side faces;

said front face having a plurality of vertically spaced slots and intermediate webs for attachment of cantilever brackets thereto;

an elongated cover on each of said standards;

said cover having a generally U-shaped cross sectional configuration with a pair of legs, said legs being resiliently biased toward each other to a freestanding spacing smaller than the spacing of said standard side faces, and shiftable against the bias to a spacing substantially equal to that of said standard side faces, to grip said standard;

said cover having a plurality of vertically spaced slots to generally align with said standard slots;

cantilever brackets having side walls and having rear lugs inserted through said cover slots and through said standard slots to anchor on said webs;

said cover extending forwardly of said standard front face and including means abutting said bracket side walls for stabilizing said brackets, whereby said brackets vertically anchor said cover relative to said standard and said cover laterally stabilizes said brackets.

2. The assembly in claim 1 wherein said U-shaped cover has an elongated space at the apex thereof, a pair of elongated spaced flanges on opposite sides of said space, extending inwardly from said apex, and webs between said cover lots and connecting the inner ends of said flanges;

said flanges straddling said cantilever brackets and providing the lateral stability to said brackets.

3. The assembly in claim 2 wherein said flanges in the free state of said cover diverge from each other away from said webs to a spacing greater than the bracket width, and are shiftable toward each other into engagement with said brackets by said shifting of said legs to a spacing substantially like that of said standard side faces.

4. The assembly in claim 3 wherein said flanges, when shifted toward each other, define a spacing smaller than the bracket width, and are spreadable by an inserted bracket against an inherent bias of said cover webs to the width of the bracket, whereby said flanges will grip an inserted bracket due to this inherent bias applied by said cover webs and the bias caused by the spreading of said legs.

5. The assembly in claim 1 wherein said cover slots are vertically longer than said standard slots.

6. The assembly in claim 1 wherein said cover legs have interior ribs to engage said standard side faces.

7. The assembly in claim 3 wherein said cover, including said legs, flanges and webs comprises an integral polymeric structure.

8. A cover for a vertical slotted standard to be mounted to a wall, comprising an elongated cover body having a generally U-shaped outer cross section with a pair of legs, said legs being resiliently biased toward each other to a freestanding spacing smaller than the width of a standard to be covered, and shiftable against the bias to a larger spacing matching the width of the standard to cover it;

said cover body also having an elongated space at the apex thereof, a air of elongated spaced flanges on opposite sides of said space extending inwardly from said apex, and webs between said cover slots connecting the inner ends of said flanges;

said webs having a plurality of vertically spaced slots to allow legs of a bracket to extend therethrough to the standard;

whereby said cover can be held in place by bracket lugs extending through said cover slots, and said cover flanges will laterally stabilize the bracket.

9. The cover in claim 8 wherein said flanges in the freestanding state diverge from each other away from said webs, and are shiftable toward each other for engaging a bracket with shifting of said legs against the bias to a larger spacing.

10. The cover in claim 9 wherein said cover body, including said legs, flanges and webs comprises an integral polymeric structure.

11. The assembly in claim 1 including a cap on at least the upper end of said standard, said cap having portions extending into said standard for retention thereto.

12. The assembly in claim 11 wherein said portions comprise resilient legs.

13. The assembly in claim 12 wherein said resilient legs have wall-engageable feet and have flex areas intermediate the ends of said legs.

14. The assembly in claim 11 including a U-shaped collar attached to said legs to be located between said cap and said cover.

15. The assembly in claim 14 wherein said legs have grooves and said collar has flanges interengageable with said grooves.

16. The assembly in claim 15 wherein said collar flanges have projections for engaging around said legs.

17. The assembly in claim 11 including a cap on the lower end of said standard.

18. A shelving standard and bracket assembly comprising:

a vertical elongated standard having a front face and a pair of spaced side faces, said front face having a plurality of vertically spaced slots and intermediate webs for attachment of brackets thereto;

an elongated cover on said standard comprising a pair of side walls over said standard side walls and a frontal portion projecting forwardly of said standard front face to be spaced therefrom;

said frontal portion having a vertical slot generally aligned with said standard slots;

a pair of spaced, inner flanges extending from said front portion, astraddle said vertical slot, toward said standard front face and interconnected by a plurality of recessed webs having recessed slots therebetween;

said recessed slots being generally aligned with said standard slots, whereby plate brackets can be inserted through said slot, said cover slots and said standard slots to engage said standard webs.

19. The assembly in claim 18 wherein said cover flanges are biased toward each other for engaging the side walls of a plate bracket.

20. The assembly in claim 18 wherein said cover slots are longer than said standard slots to cause frontal exposed portions of said standard webs.

21. The assembly in claim 18 wherein said cover including said side wall flanges and webs are of an integral polymeric structure.

22. The assembly in claim 21 wherein said side walls are resiliently biased into engagement with said standard side walls.

23. The assembly in claim 21 wherein said cover webs are in engagement with said standard webs.

24. A cover for a vertical slotted standard to be mounted to a wall, comprising an elongated cover body having a generally U-shaped outer cross section with a pair of legs, said legs having means for engaging a vertical standard to cover the standard;

said cover body also having an elongated space at the apex thereof, a pair of elongated spaced flanges on opposite sides of said space extending inwardly from said apex, and webs between said cover slots connecting the inner ends of said flanges;

said webs having a plurality of vertically spaced slots recessed from said apex to generally be out of sight, and to allow legs of a bracket to extend therethrough to the standard;

whereby said cover can be vertically held in place by bracket lugs extending through said cover slots, and said cover flanges can laterally stabilize the bracket.

25. The cover in claim 24 wherein said cover, including said legs, flanges and webs comprises an integral polymeric structure.

26. The cover in claim 25 wherein said engaging means comprises ribs being resiliently biased for engagement with the standard.

27. A wire clip for attachment to a slotted vertical standard for holding vertically oriented electrical wires adjacent said standard, comprising:

a clip body having a generally U-shaped configuration including a pair of spaced legs to engage the standard;

a wire receiving hook on at least one of said legs, projecting therefrom and having an outer portion extending generally parallel to said body, spaced therefrom;

said body having a protrusion extending between said legs midway therebetween, and a lug on said protrusion to engage the slotted standard for attachment thereto.

28. The assembly in claim 27 wherein said body, hook, protrusion and lug comprise an integral polymeric structure.

* * * * *

UNITED STATES PATENT AND TRADEMARK OFFICE

CERTIFICATE OF CORRECTION

PATENT NO. : 4,966,343

DATED : October 30, 1990

INVENTOR(S) : Walter L. Bessinger et al.

It is certified that error appears in the above-identified patent and that said Letters Patent is hereby corrected as shown below:

Column 1, line 50:
"PIN and CLIP" should read --PIN AND CLIP--;

Column 5, line 50:
"a amount" should read --an amount--;

Column 10, line 23:
"lots" should read --slots--;

Column 10, line 59:
"a air" should read --a pair--.

Signed and Sealed this

Seventeenth Day of March, 1992

*Attest:*

HARRY F. MANBECK, JR.

*Attesting Officer*

*Commissioner of Patents and Trademarks*